US010724714B2

(12) United States Patent
Schattner et al.

(10) Patent No.: US 10,724,714 B2
(45) Date of Patent: Jul. 28, 2020

(54) ADJUSTABLE SENSOR MOUNTING SYSTEM

(71) Applicant: Eaton Intelligent Power Limited, Dublin (IE)

(72) Inventors: David Schattner, Newnan, GA (US); Jonathan Whitten, Senoia, GA (US)

(73) Assignee: Signify Holding B.V., Eindhoven (NL)

( * ) Notice: Subject to any disclaimer, the term of this patent is extended or adjusted under 35 U.S.C. 154(b) by 290 days.

(21) Appl. No.: 15/902,744

(22) Filed: Feb. 22, 2018

(65) Prior Publication Data

US 2019/0257500 A1 Aug. 22, 2019

(51) Int. Cl.

| | |
|---|---|
| ***F21V 21/00*** | (2006.01) |
| ***F21V 21/04*** | (2006.01) |
| ***F21V 21/14*** | (2006.01) |
| ***F21V 23/04*** | (2006.01) |

(52) U.S. Cl.

CPC ..... *F21V 21/048* (2013.01); *F21V 21/14* (2013.01); *F21V 23/0442* (2013.01)

(58) Field of Classification Search

CPC ..... H02G 3/20; H02G 3/123; G01D 11/30; G01D 11/245

USPC ..... 248/342, 343, 344

See application file for complete search history.

(56) References Cited

U.S. PATENT DOCUMENTS

| | | | | |
|---|---|---|---|---|
| 6,976,662 | B2 * | 12/2005 | Kump | E04B 9/006 248/222.52 |
| 9,827,514 | B2 * | 11/2017 | Alkalay | B01D 24/4626 |
| 2004/0213429 | A1 * | 10/2004 | Seidler | H04R 1/025 381/386 |
| 2005/0024883 | A1 * | 2/2005 | Wu | F21S 8/065 362/430 |
| 2016/0153814 | A1 * | 6/2016 | Seimori | G01N 33/0054 73/431 |
| 2019/0316940 | A1 * | 10/2019 | Tener | G01J 5/046 |

* cited by examiner

*Primary Examiner* — Steven M Marsh
(74) *Attorney, Agent, or Firm* — King & Spalding LLP

(57) ABSTRACT

A mounting system includes a threaded body that is configured to securely retain an electronic component therein. The threaded body includes a core that defines an inner cavity extending therethrough, and a bottom flange that extends radially outward from an annular bottom edge of the core. The threaded body includes a plurality of fins that are substantially vertically oriented and extend radially outward from the core. The outer edges of the plurality of fins are indexed to collectively form a helical structure that defines a screw thread. The mounting system also includes a nut member that defines a center cavity that extends therethrough and includes an inner flange that defines a complementary screw thread. The mounting system is installed in the ceiling tile by removably coupling the nut member to the threaded body such that the ceiling tile is clamped between the bottom flange and the nut member.

18 Claims, 8 Drawing Sheets

ADJUSTABLE SENSOR MOUNTING SYSTEM

TECHNICAL FIELD

The present disclosure relates generally to lighting solutions, and more particularly to an adjustable sensor mounting system.

BACKGROUND

The operation of luminaires can be made more efficient and smarter by using various electronic components. Examples of such electronic components may include, but are not limited to, sensors such as motion sensors, occupancy sensors, light sensors, etc. Typically, said electronic components may be installed in ceiling tiles using a suitable mounting system. However, the ceiling tiles are manufactured to several different standard thicknesses, e.g., ½ inch, ⅝ inch, and ¾ inch, and the dimensional tolerances for each standard ceiling thickness may vary widely.

Conventional mounting systems do not readily accommodate mounting said electronic components to ceiling tiles of different thicknesses and adjusting to their varying tolerances. That is, conventional mounting systems may have different mounts for mounting the electronic components in ceiling tiles having different thickness, which may be inefficient and cost intensive. Further, conventional mounting systems may damage the ceiling tiles. For example, a conventional mounting system with a spring mechanism may include a wall anchor style mounting structure with spring clips that fan out and bite into the ceiling tile to hold the electronic component in place within the ceiling tile. Removing said wall anchor style mounting structure from the ceiling tile may cause the ceiling tile to break, crumble, and/or sustain extensive damage, thereby rendering the ceiling tile inoperable for future use. Furthermore, conventional mounting systems tend to creep or deform over time under the weight of a sustained load which causes the mounting system to push down and out from the ceiling tile which may be aesthetically unappealing.

This background information is provided to reveal information believed to be of possible relevance to the present disclosure. No admission is necessarily intended, nor should be construed, that any of the preceding information constitutes prior art against the present disclosure.

SUMMARY

In one aspect, the present disclosure is related to a mounting system that includes a threaded body and a nut member. The threaded body includes a core extending from a top annular edge to a bottom annular edge. The threaded body is configured to retain an electronic component in an inner cavity defined by the core. Further, the threaded body includes a bottom flange extending radially outward from the bottom annular edge of the core, and a plurality of fins extending radially outward from the core. An outer edge of each fin of the plurality of fins includes a plurality of grooves such that a combination of the plurality of grooves of the plurality of fins form a helical structure that defines a single screw thread. The nut member includes an inner side wall that defines a central cavity extending through the nut member. Further, the nut member includes a flange extending radially inward from the inner side wall, where the flange defines a complementary single screw thread. When the mounting system is installed in a ceiling tile, the nut member is removably coupled to the threaded body such that the ceiling tile is clamped between the nut member and the bottom flange of the threaded body.

In another aspect, the present disclosure is related to a sensor mounting system includes a threaded body and a nut member. The threaded body includes an inner surface that defines a cavity which is configured to securely retain a sensor therein, an outer surface that is indexed to form an external screw thread, and a bottom flange that extends radially outward from a bottom edge of the threaded body. The nut member includes a central cavity that extends therethrough and an internal screw thread that extends radially inward from an inner side wall of the nut member towards the central cavity. The sensor mounting system is configured to be installed in a ceiling tile by removably coupling the nut member to the threaded body such that: the threaded body is received through the central cavity of the nut member, the external screw thread of the threaded body engages the internal screw thread of the nut member, and the ceiling tile is clamped between the nut member and the bottom flange of the threaded body.

These and other aspects, objects, features, and embodiments, will be apparent from the following description and the appended claims.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1:
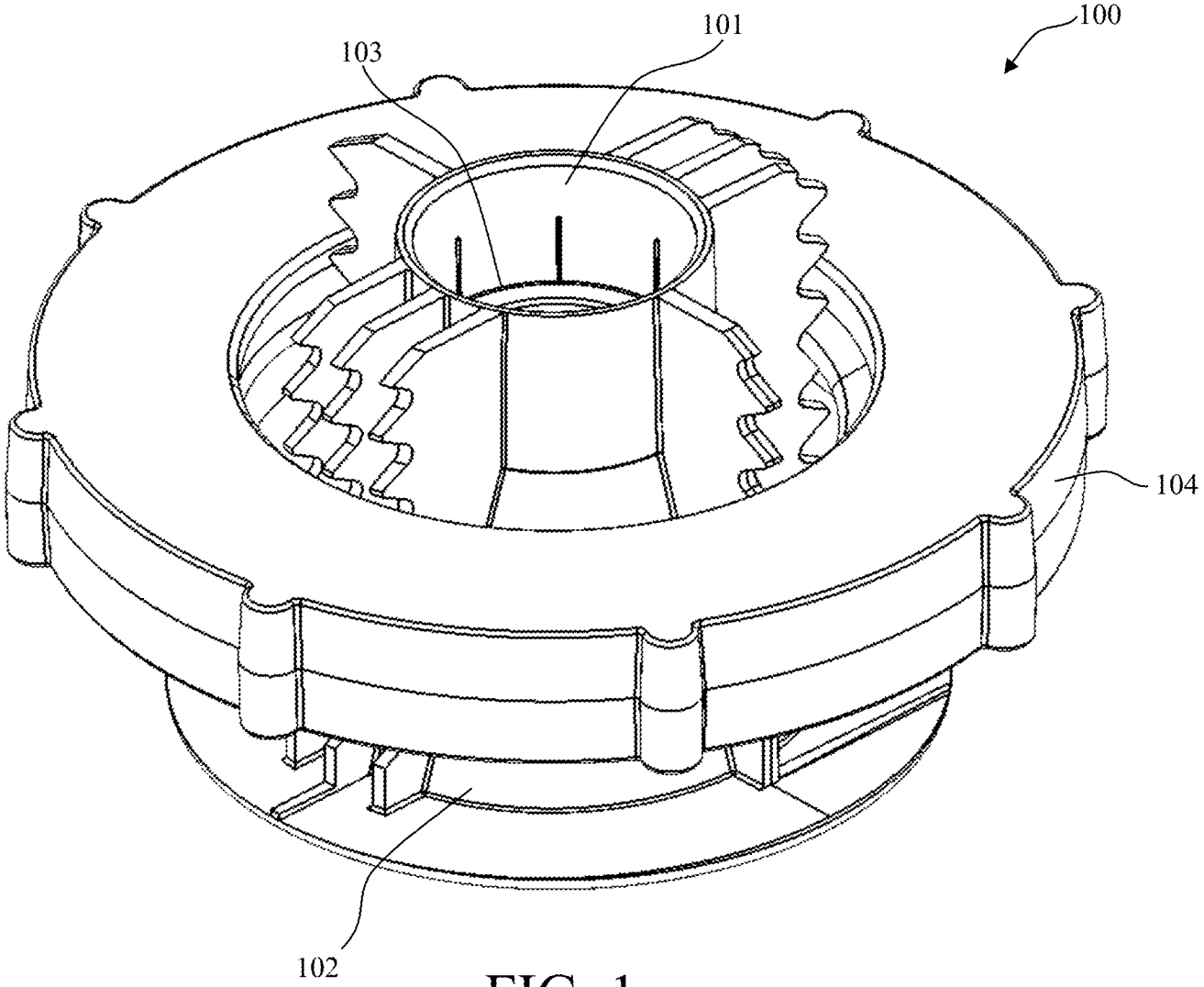
FIG. 1 illustrates a top perspective view of an example mounting system for mounting a sensor in a ceiling tile, in accordance with example embodiments of the present disclosure.

The drawings illustrate only example embodiments of the present disclosure and are therefore not to be considered limiting of its scope, as the present disclosure may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles.

In the foregoing figures showing example embodiments of mounting systems, one or more of the components shown may be omitted, repeated, and/or substituted. Accordingly, the example embodiments of mounting systems should not be considered limited to the specific arrangements of components shown in any of the figures. For example, features shown in one or more figures or described with respect to one embodiment can be applied to another embodiment associated with a different figure or description.

DETAILED DESCRIPTION OF EXAMPLE EMBODIMENTS

The present disclosure describes a mounting system for a tool-less mounting of a sensor in a ceiling tile. The mounting system of the present disclosure is configured for attachment to a multiplicity of ceiling tiles having different thickness. Further, the mounting system of the present disclosure is configured to mount the sensor in the ceiling tile without causing extensive damage to the ceiling tile. Furthermore, the mounting system of the present disclosure is configured to maintain its structural integrity and not creep over time under a sustained load.

An example mounting system of the present disclosure includes a threaded body and a nut assembly, where the threaded body securely retains the sensor therein and the nut spins down upon or is screwed onto the threaded body to a desired ceiling tile thickness to securely mount and retain the sensor in the ceiling tile without causing extensive damage to the ceiling tile.

Example embodiments of the mounting system will be described more fully hereinafter with reference to the accompanying drawings that describe representative embodiments of the present technology. If a component of a figure is described but not expressly shown or labeled in that figure, the label used for a corresponding component in another figure can be inferred to that component. Conversely, if a component in a figure is labeled but not described, the description for such component can be substantially the same as the description for a corresponding component in another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

The technology of the mounting system may be embodied in many different forms and should not be construed as being limited to the embodiments set forth herein; rather, these embodiments are provided so that this disclosure will be thorough and complete, and will fully convey the scope of the technology to those appropriately skilled in the art. Further, in addition to the ceiling tile, example embodiments of the present disclosure can be located in any appropriate wall or mounting surface. Furthermore, the mounting system of the present disclosure can be used with any appropriate lighting system, such as, long run lighting, can lighting (recessed lighting), etc., to control an operation of the lighting system based on input received from the sensors mounted by the mounting system.

Mounting systems (or components thereof) described herein can be made of one or more of a number of suitable materials to allow the mounting system and/or other associated components of the mounting system to meet certain standards and/or regulations while also maintaining durability with respect to the one or more conditions under which the mounting system and/or other associated components of the system can be exposed. Examples of such materials can include, but are not limited to, plastic, aluminum, stainless steel, copper, fiberglass, ceramic, etc.

Further, components of the mounting system (or portions thereof) described herein can be made from a single piece (as from a mold, injection mold, die cast, or extrusion process). In addition, or in the alternative, components of the mounting system (or portions thereof) can be made from multiple pieces that are mechanically coupled to each other. In such a case, the multiple pieces can be mechanically coupled to each other using one or more of a number of coupling methods, including but not limited to adhesives, welding, soldering, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Terms such as "first", "second", "third", "top", "bottom", "side", and "within" are used merely to distinguish one component (or part of a component or state of a component) from another. Such terms are not meant to denote a preference or a particular orientation, and are not meant to limit embodiments of the mounting system. In the following detailed description of the example embodiments, numerous specific details are set forth in order to provide a more thorough understanding of the present disclosure. However, it will be apparent to one of ordinary skill in the art that the mounting system of the present disclosure may be practiced without these specific details. In other instances, well-known features have not been described in detail to avoid unnecessarily complicating the description.

Turning now to the figures, example embodiments of a mounting system will be described in connection with FIGS. 1-7. Referring to FIGS. 1-7, an example mounting system 100 may include a threaded body 102 and a nut member 104 that may be removably coupled to the threaded body 102 to securely mount a sensor 604 retained in the threaded body 102 to a ceiling tile 602 (shown in FIG. 6).

Figure 2:
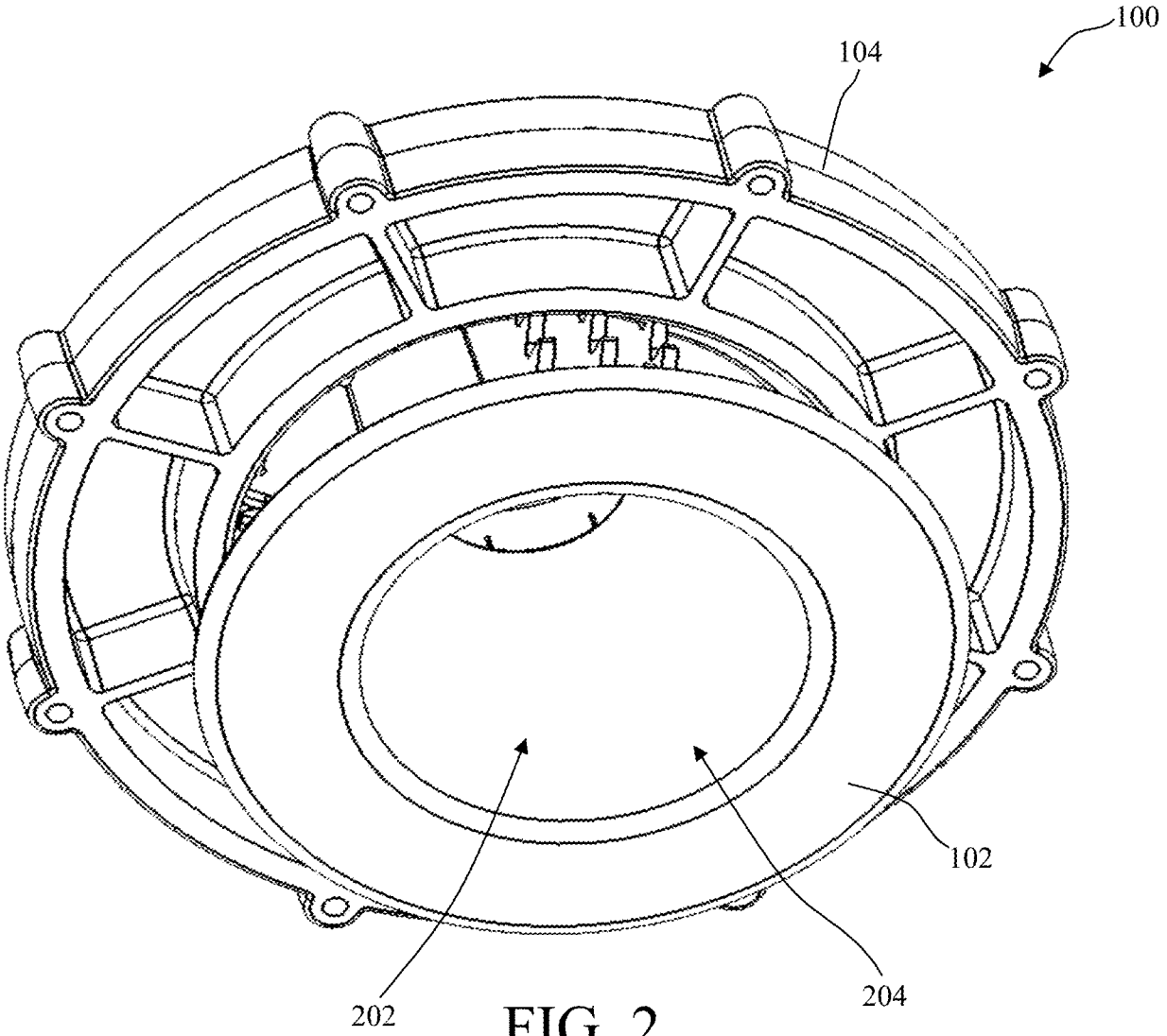
FIG. 2 illustrates a bottom perspective view of the example mounting system of FIG. 1, in accordance with example embodiments of the present disclosure.
Figure 3:
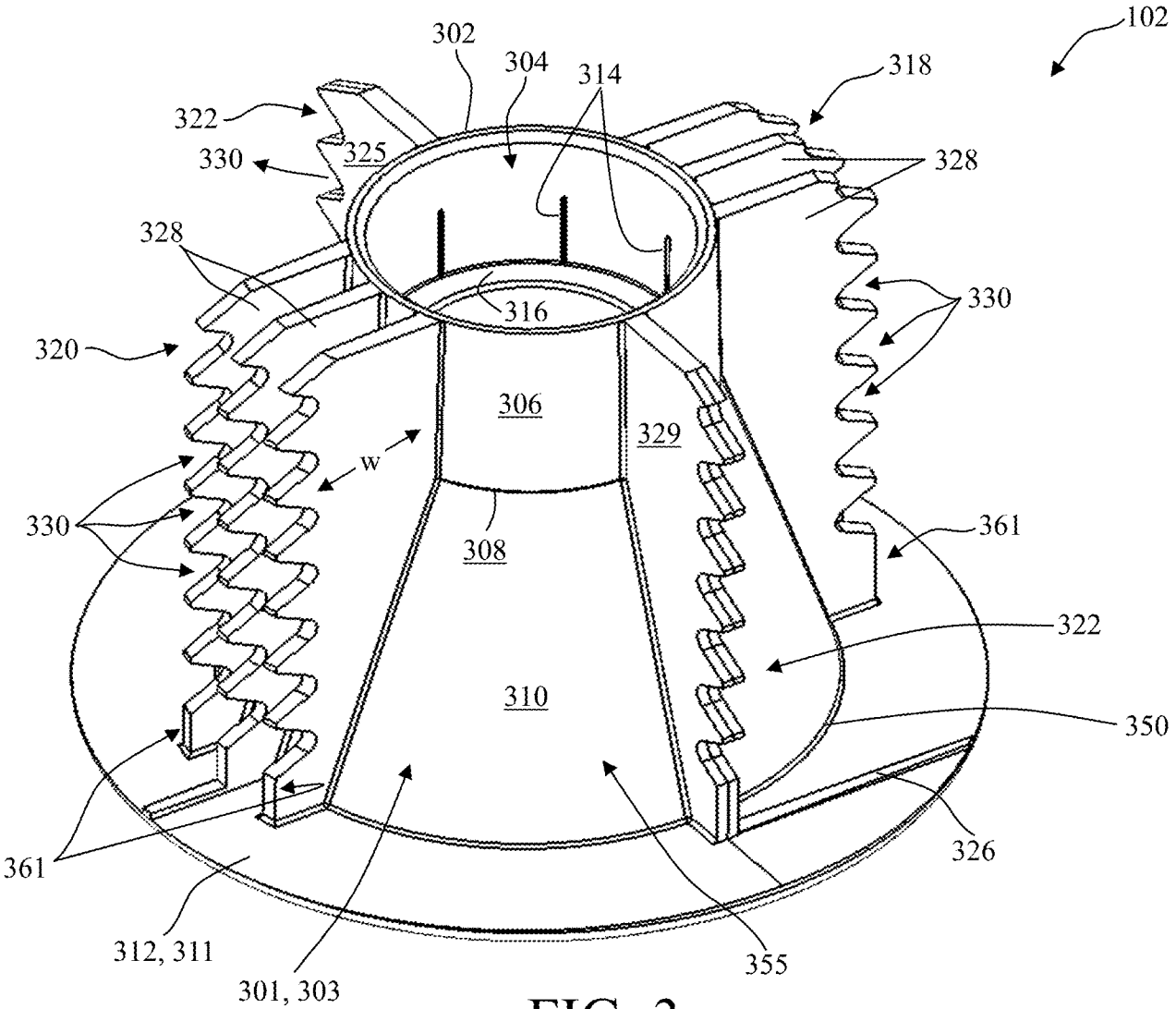
FIG. 3 illustrates a perspective view of the threaded body of the mounting system of FIG. 1, in accordance with example embodiments of the present disclosure.
Figure 4:
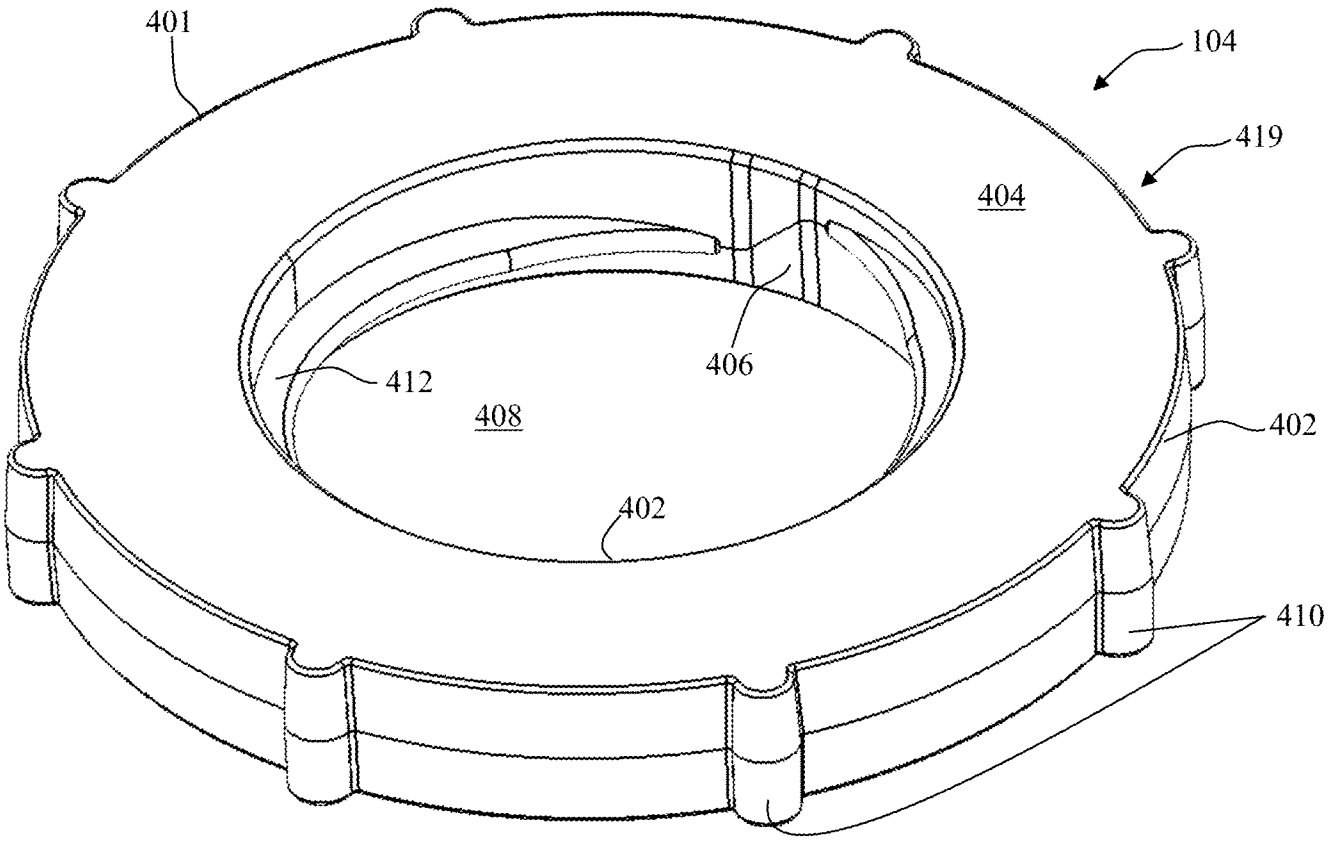
FIG. 4 illustrates a perspective view of the nut member of the mounting system of FIG. 1, in accordance with example embodiments of the present disclosure.

The threaded body 102 may include a substantially funnel shaped core 301 (shown in FIG. 3) that has a side wall 303 extending from an annular top edge 302 that defines a top aperture 304 to an annular bottom edge 350 that defines a bottom aperture 202 (shown in FIG. 2). The side wall 303 may include a top portion 306 that is substantially cylindrical in shape and a bottom portion 310 that is shaped like a frustum of a cone. In other words, the side wall 303 of the core 301 flares out or widens towards the bottom annular edge 350 such that a diameter of the bottom annular edge 350 is larger than a diameter of the top annular edge 302. Further, the side wall 303 may include an inner surface 204 and an outer surface 355 (shown in FIG. 3).

On the outer surface 355, the top portion 306 of the side wall 303 may extend from the annular top edge 302 to an outer intermediate edge 308 that is positioned between the annular top edge 302 and the annular bottom edge 350; and the bottom portion 310 may extend from the outer intermediate edge 308 to the annular bottom edge 350. On the inner surface 204, the top portion 306 of the side wall 303 may extend from the annular top edge 302 to an inner intermediate edge 103 (shown in FIG. 1 and FIGS. 5A and 5B) that is positioned between the annular top edge 302 and the annular bottom edge 350. Further, on the inner surface 204, the core 301 may include an inner collar 316 that extends substantially horizontally and radially inward from the inner intermediate edge 103; and the bottom portion 310 may extend from a perimeter 501 (shown in FIGS. 5A and 5B (hereinafter collectively referred to as 'FIG. 5')) of the collar 316 to the annular bottom edge 350. The collar 316 may define an intermediate aperture 503 that has a diameter that is smaller than the diameter of the top aperture 304 and the bottom aperture 202. As illustrated in FIG. 5B, the inner intermediate edge 103 may be positioned above or higher than the outer intermediate edge 308.

Furthermore, as illustrated in FIGS. 1-3 and 5-6, the inner surface 204 of the side wall 303 may define an inner cavity 550 that extends through the core 301, i.e., from the top aperture 304 through the intermediate aperture 503 and the bottom aperture 202. The inner cavity 550 may widen from the top aperture 304 to the bottom aperture 202. Additionally, the inner surface 204 of the side wall 303 may include a plurality of crush ribs 314, each crush rib 314 extending from the inner intermediate edge 103 towards the annular top edge 302. The crush ribs 314 and the collar 316 may operate in concert to securely retain a sensor 604 (shown in FIGS. 6 and 7) within the core 301. For example, the sensor 604 may be pushed and/or twisted into the inner cavity 550 from the top aperture 304 defined by the annular top edge 302 towards the collar 316 such that the body of the sensor 604 rests on the collar 316 and a sensing portion of the sensor 604 (e.g., sensor head, lens, etc.) extends through the intermediate aperture 503 towards the bottom portion 310 of the core 301 to receive light collected by the bottom portion 310 of the core 301. In other words, the collar 316 of the core 301 is configured to support the sensor 604. As the sensor 604 is pushed and/or twisted into the inner cavity 550 towards the collar 316, the shoulder 704 or any other appropriate portion on the outer surface of sensor 604 (shown in FIG. 7) may cut into and create grooves in the crush ribs 314. The grooves that are cut into the crush ribs 314 may capture and vertically hold the sensor 604 within the inner cavity 550 of the core 301. In other words, as the sensor 604 engages the crush ribs 314, the crush ribs 314 are configured to provide localized deflections to securely retain the sensor 604 within the core 301.

Further, the sensor 604 may be removed from the cavity 550 of the core 301 by pulling and/or twisting the sensor 604 upward and away from the core 301. Accordingly, the sensor 604 can be attached and/or detached from the mounting system 100 easily and without the use of any specialized tools, e.g., the sensor 604 can be attached to the threaded body 102 by pushing the sensor 604 into the cavity 550 defined by the core 301 and the sensor 604 can be detached from the threaded body 102 by pulling the sensor 604 out from the cavity 550 defined by the core 301.

The shape of the core 301 as described above is configured to control the amount of light that is collected and guided towards the sensor 604 that is retained in the core 301. In particular, the bottom portion 310 of the core 301 that is shaped substantially like a frustum of a cone ensures that the sensor 604 receives an optimal amount of light, i.e., not too much light or too little light. Even though the present disclosure describes the core 301 as being shaped substantially like a funnel, one of skill in the art can understand and appreciate that the core can have any other appropriate geometric or non-geometric shape without departing from a broader scope of the present disclosure. For example, in some embodiments, the core 301 can be cylindrical in shape, i.e., a constant diameter from the annular top edge 302 to the annular bottom edge 350. The cylindrical shaped core may allow a larger amount of light to reach the sensor disposed therein than the funnel shaped core. Further, even though the present disclosure describes using crush ribs to vertically and securely hold the sensor in the cavity defined by the core, one of skill in the art can understand and appreciate that any other appropriate securing mechanism may be used without departing from a broader scope of the present disclosure. For example, the inner surface of the side wall of the core may be threaded such that the sensor can be screwed into the core 301. In another example, if the core is made of metal, the core may be designed to securely retain the sensor using interference or press fit.

Figure 6:
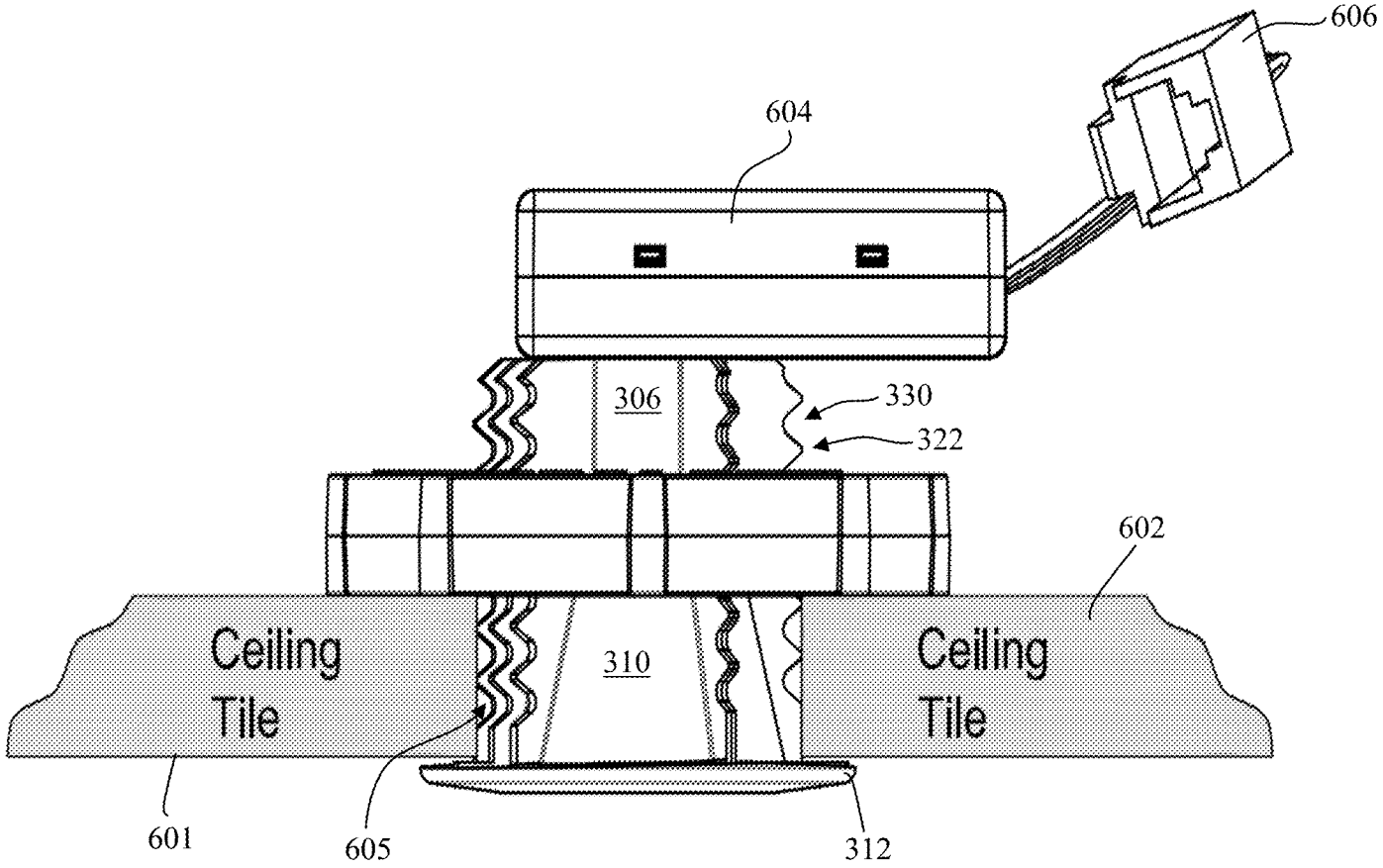
FIG. 6 illustrates a side view of the mounting system of FIG. 1 mounted in a ceiling tile, in accordance with example embodiments of the present disclosure.
Figure 7:
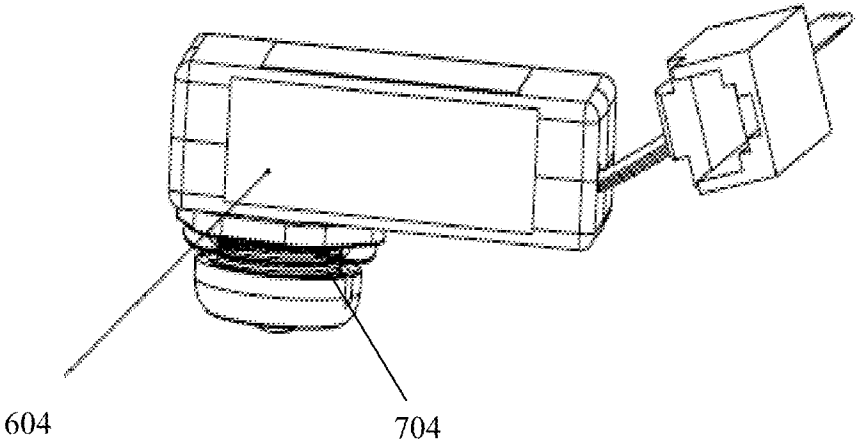
FIG. 7 illustrates a perspective view of an example sensor that is mounted by the mounting system of FIG. 1, in accordance with example embodiments of the present disclosure.

In addition to the core 301, the threaded body 102 may include a bottom flange 312 that extends substantially horizontally and radially outward from the bottom annular edge 350 of the core 301. The bottom flange 312 may include one or more grip ribs 326 formed on a top surface 311 of the bottom flange 312. The grip ribs 326 may be configured to provide a better grip into the ceiling tile 602 when the bottom flange 312 engages the ceiling tile 602 during the installation of the mounting system 100 in the ceiling tile 602 as shown in FIG. 6.

Furthermore, the threaded body 102 may include multiple sets of fins (318, 320, and 322) that extend radially outward from the outer surface 355 of the core 301. As illustrated in FIGS. 1-3 and 5-6, some sets of fins (318, 320) may include more than one fin 328, while other sets of fins 322 may include only one fin 324. In either case, each fin (324, 328) may being substantially vertically oriented and may extend from the annular top edge 302 of the core 301 to the bottom flange 312 of the threaded body 102. Further, the width 'w' of each fin (324, 328) may increase from the bottom flange 312 towards the top annular edge 302 of the core 301. Adjacent sets of fins (318, 320, and 322) may be detached, separated, and spaced apart from each other. Similarly, each fin (324, 328) within a set (318, 320, and 322) may also be detached, separated, and spaced apart from each other. The separation or distance between the different sets of fins (318, 320, and 322) may be larger than the separation or distance between fins 328 that define a set, e.g., set 318 and 322. The outer edges 361 (vertical edges) of each fin (324, 328) of the multiple sets of fins (318, 320, and 322) may be indexed to form a plurality of grooves 330 that together form a helical groove pattern defining a single screw thread. That is, the plurality of grooves 330 of the multiple sets of the fins (324, 328) collectively form a helical structure that defines an external or male single screw thread pattern.

In addition to the threaded body 102, the mounting system 100 may include the nut member 104. The nut member 104 may have a ring shaped body 419 that defines a central cavity 408 that extends through the nut member 104. The body 419 of the nut member 104 may include an annular top wall 404 that has an inner annular edge 402 and an outer annular edge 402, where the diameter of the outer annular edge 401 is larger than the diameter of the inner annular edge 402. Further, the body 419 of the nut member 104 may include and an inner side wall 406 that is substantially perpendicular to the top wall 404 and extends from and along the inner annular edge 402; and an outer side wall 402 that is substantially perpendicular to the top wall 404 and extends from and along the outer annular edge 402. The inner side wall 406 defines the central cavity 408. Furthermore, the nut member 104 may include a flange 412 that extends radially and substantially horizontally inward into the central cavity 408 of the nut member 104 from the inner side wall 406. In some example embodiments, the flange 412 may extend circumferentially around the inner side wall 406, while in other example embodiments such as in FIG. 4, the flange 412 extends partially along the inner side wall 406. The flange 412 defines a single screw thread pattern that is matching or complementary to the external or male single screw thread pattern defined by the plurality of grooves 330 on the outer edges 361 of the multiple sets of fins (318-322) on the threaded body 102. That is, the flange 412 of the nut member 104 defines an internal or female single screw thread pattern for engaging with the external or make single screw thread pattern of the threaded body 102 to removably couple the nut member 104 to the threaded body 102. It is noted that the male and female single screw threads on the threaded body 102 and the nut member 104, respectively, are designed to have a coefficient of friction that ensures that the nut member 104 and the threaded body 102 do not unscrew from each other under their own weight.

In addition to the flange 412 that defines the interior or female single screw thread pattern, the nut member 104 further includes a plurality of semi-cylindrical projections or ribs 410 that extend radially outward from the outer side wall 402 and are spaced apart from each other. The plurality of semi-cylindrical projections or ribs 410 are configured to operate as hand grips to provide grip to a user when the nut member 104 is removably coupled to the threaded body 102, thereby eliminating the need for tools to couple the nut member 104 to the threaded body 102. Even though the present disclosure describes the nut member 104 as including the plurality of semi-cylindrical projections or ribs 410 as hand grips, one of skill in the art can understand and appreciate that in other example embodiments, the nut member 104 may not include the hand grips 410 or alternatively, the nut member 104 may include any other appropriate grip feature without departing from a broader scope of the present disclosure.

Figure 5A:
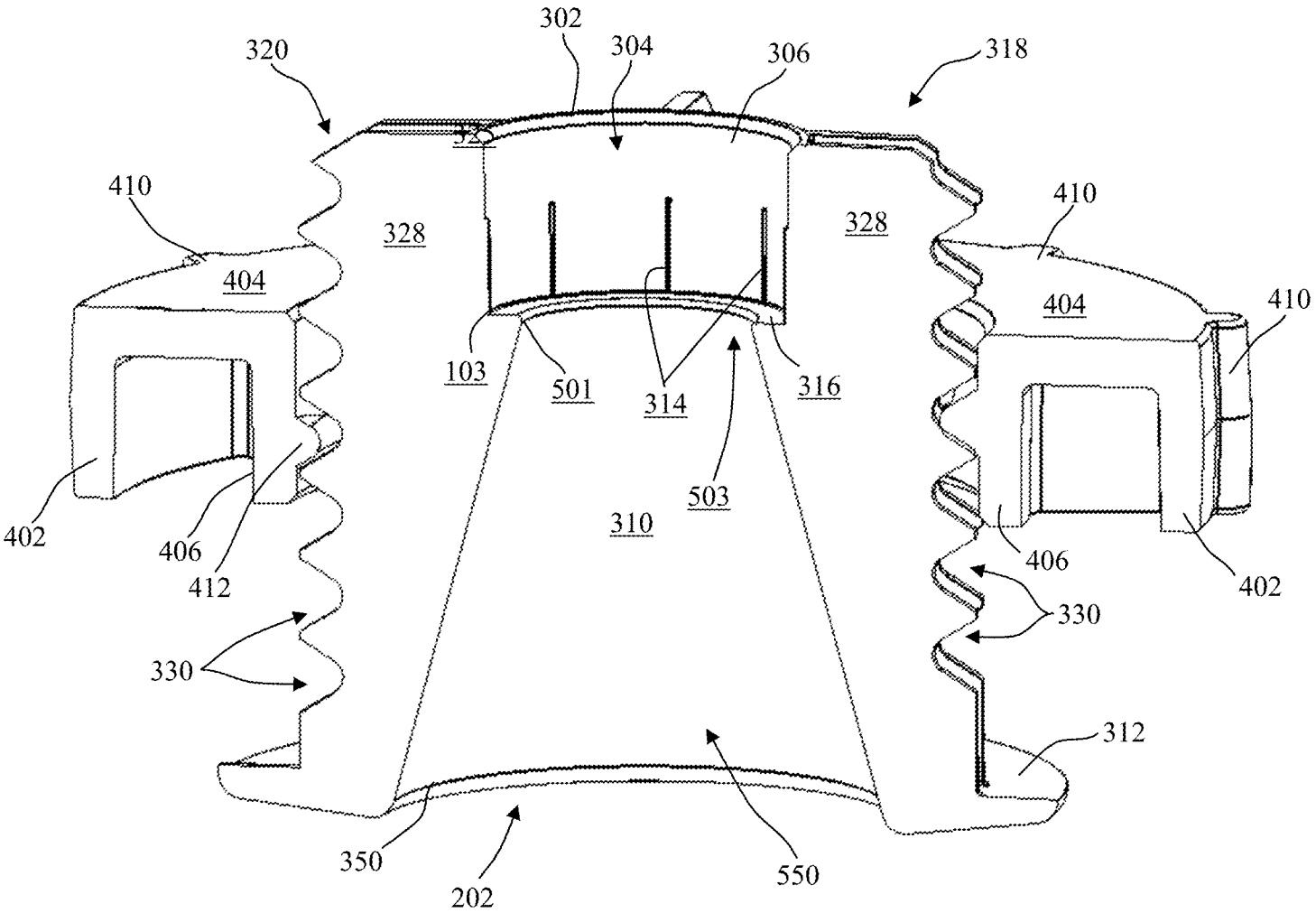
FIG. 5A illustrates a sectional view of the mounting system of FIG. 1, in accordance with example embodiments of the present disclosure.
Figure 5B:
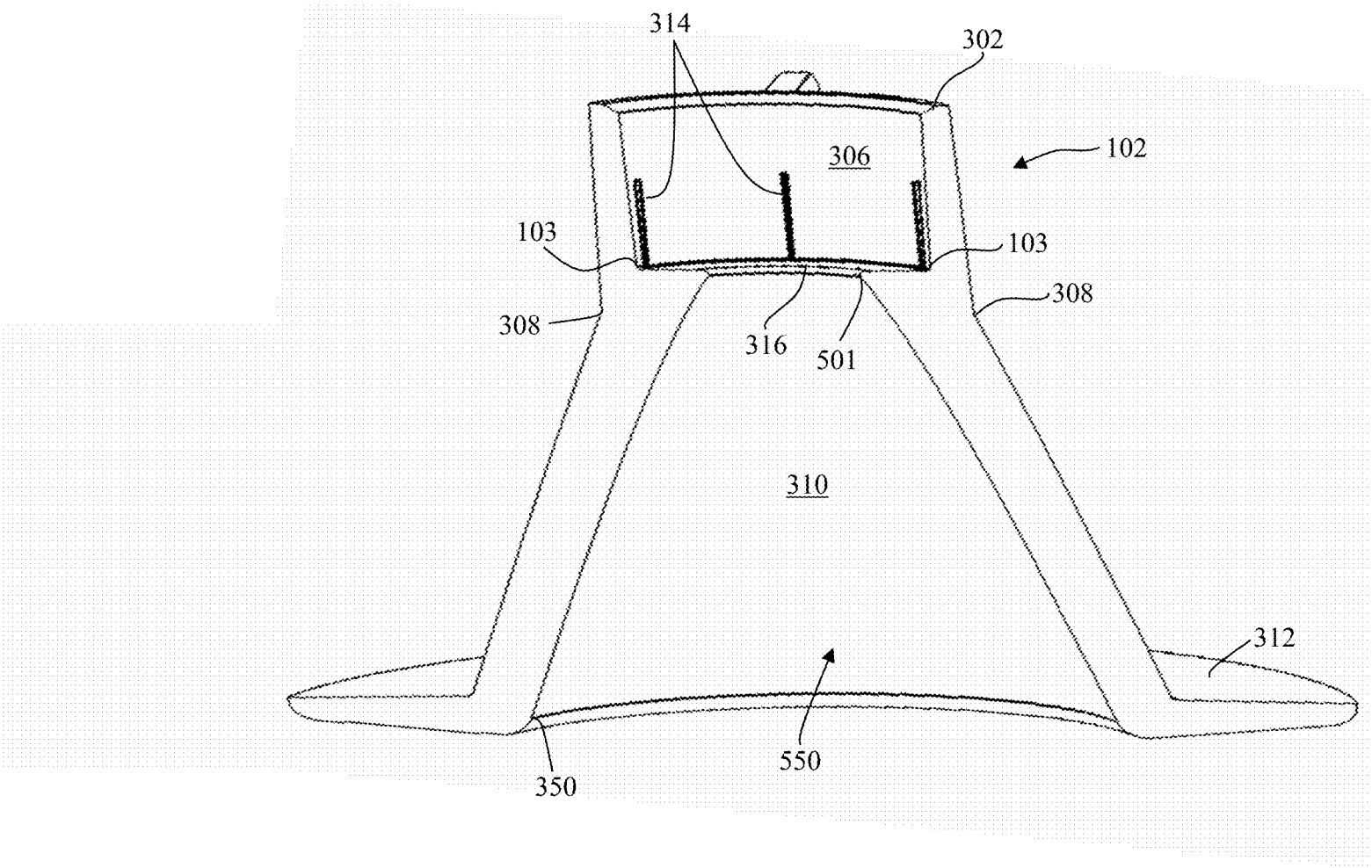
FIG. 5B illustrates a sectional view of the threaded body of FIG. 3, in accordance with example embodiments of the present disclosure.

As illustrated in FIGS. 5A and 6, the mounting assembly may be installed in the ceiling tile 602 by positioning the threaded body 102 beneath the ceiling tile 602 such that the threaded body 102 is axially aligned with an aperture 605 in the ceiling tile 602. Then, the threaded body 102 is pushed upwards and inserted through the aperture 605 in the ceiling tile 602 such that a top portion 306 of the threaded body 102 extends behind the ceiling tile 602. The threaded body 102 is pushed upwards through the aperture 605 in the ceiling tile 602 till the top surface 311 of the bottom flange 312 engages the bottom surface 601 of the ceiling tile 602. The bottom flange 312 is configured to conceal the gap between the aperture 605 in the ceiling tile 602 and the body of the threaded member 102. Then, from behind the ceiling tile 602, the nut member 104 is spun unto or screwed onto the threaded body 102 to a desired ceiling tile thickness such that the ceiling tile 602 is clamped between the nut member 104 and the bottom flange 312 of the threaded body 102.

As illustrated in FIG. 5, to removably couple the nut member 104 to the threaded body 102, the flange 412 of the nut member 104 that defines the interior or female single screw thread engages the complementary plurality of grooves 330 on the outer edges 361 of the multiple sets of fins (318-322) on the threaded body 102 that define the external or male screw thread. The depth to which the nut member 104 may be screwed onto the threaded body 102 may vary based on the thickness of the ceiling tile 602, where the depth is measured as distance from the bottom flange 312 of the threaded body 102 and the nut member 104. For example, the depth to which the nut member 104 may be screwed onto the threaded body 102 in a thick ceiling installation may be larger than the depth to which the nut member 104 may be screwed onto the threaded body 102 in a thin ceiling installation.

It is noted that the nut member 104 and threaded body 102 assembly allows a single mounting system 100 to mount the electronic component, such as the sensor 604, to a multiplicity of ceiling tiles of different thicknesses, one at a time. Further, it is noted that the nut member 104 and the bottom flange 312 of the threaded body 102 may have a sufficiently large surface area to gently grab the ceiling tiles 602 without crumbling or destroying the ceiling tiles 602. Responsive to screwing and tightening the nut member 104 onto the threaded body 102, the sensor 604 is inserted vertically into the inner cavity 550 defined by the core 301 of the threaded body 102 through the top aperture 304 defined by the annular top edge 302 of the core 301 such that the outer surface of the sensor 604 cuts into the crush ribs 314 and the sensor 604 rests on the collar 316 in the core 301 to securely retain the sensor 604 in the threaded body. Furthermore, it is noted that the mounting system 100 of the present disclosure does not creep under sustained loads of the electronic components, such as the sensor 604. Responsive to disposing the sensor 604 in the threaded body 102, the user may make electrical connections between the sensor 604 and a control module using suitable connectors, such as connector 606.

To remove the mounting system 100 from the ceiling tile 602, initially the sensor 604 is pulled out of the threaded body 102. Then, the nut member 104 is unscrewed from the threaded body 102 and the threaded body 102 is pushed downwards through the aperture in the ceiling tile 602 to remove the threaded body 102 from the ceiling tile 602.

Even though the present disclosure describes the bottom flange 312 of the threaded body 102 as being circular or ring shaped and horizontally extending from the annular bottom edge 350 of the core 301, one of ordinary skill in the art can understand and appreciate that in other example embodiments, the bottom flange 312 may have any other appropriate geometric or non-geometric shape and may extend radially outward from the annular bottom edge 350 at an obtuse angle or acute angle to the core 301. Further, even though the present disclosure describes the nut member 104 as being a ring shaped structure, one of skill in the art can appreciate that in other example embodiments, the nut member can have any other appropriate geometric or non-geometric shape without departing from a broader scope of the present disclosure. In yet another example embodiment, the threaded body 102 may not include the fins, such as when the core of the threaded body is cylindrical. Instead, in said another example embodiment, the single screw thread may be formed directly on the outer surface 355 of the cylindrical core 301. The present disclosure allows any amorphous or geometric body to operate as a screw by the use of fins that extend from the body and by defining a screw thread pattern on the outer edge of said fins as described above.

Although example embodiments are described herein, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A mounting system comprising:

a threaded body that includes:

a core extending from a top annular edge to a bottom annular edge and configured to retain an electronic component in an inner cavity defined by the core;

a plurality of crush ribs disposed on an inner surface of the core and extending from an inner intermediate edge towards the top annular edge of the core, the plurality of crush ribs configured to securely retain the electronic component within the inner cavity defined by the core;

a bottom flange extending radially outward from the bottom annular edge of the core; and a plurality of fins extending radially outward from the core, wherein an outer edge of each fin of the plurality of fins comprises a plurality of grooves such that a combination of the plurality of grooves of the plurality of fins form a helical structure that defines a single screw thread; and a nut member comprising:

an inner side wall that defines a central cavity extending through the nut member; and a flange extending radially inward from the inner side wall, wherein the flange defines a complementary single screw thread, wherein when the mounting system is installed in a ceiling tile, the nut member is removably coupled to the threaded body such that the ceiling tile is clamped between the nut member and the bottom flange of the threaded body.

2. The mounting system of claim 1:

wherein the threaded body comprises an inner collar that extends substantially horizontally and radially inward from the inner intermediate edge of the core towards the inner cavity defined by the core, wherein the inner intermediate edge is positioned between the top annular edge and the bottom annular edge of the core, and wherein the inner collar is configured to support the electronic component within the inner cavity of the core.

3. The mounting system of claim 1, wherein each fin of the plurality of fins is substantially vertically oriented and extends from the bottom flange of the threaded body to the top annular edge of the core of the threaded body.

4. The mounting system of claim 1, wherein the bottom flange of the threaded body comprises one or more grip ribs that are formed on a top surface of the bottom flange.

5. The mounting system of claim 1, wherein the nut member comprises:

an annular top wall comprising an inner edge and an outer edge, the inner side wall extending from the inner edge and substantially perpendicular to the top wall, an outer side wall extending from the outer edge and substantially perpendicular to the top wall, and a plurality of substantially semi-cylindrical ribs that extend radially outward from the outer side wall and define hand grips for removably coupling the nut member to the threaded body.

6. The mounting system of claim 1, wherein the core is a substantially funnel shaped structure.

7. The mounting system of claim 1, wherein the top annular edge defines a top aperture and the bottom annular edge defines a bottom aperture, and wherein a diameter of the bottom aperture is larger than a diameter of the top aperture.

8. The mounting system of claim 2, wherein the inner collar defines an intermediate aperture that is positioned between a top aperture defined by the top annular edge of the core and a bottom aperture that is defined by the bottom annular edge of the core, and wherein the intermediate aperture is configured to receive a portion of the electronic component therethrough.

9. The mounting system of claim 1, wherein the electronic component is a daylight sensor.

10. A sensor mounting system comprising:

a threaded body that comprises:

an inner surface that defines a cavity which is configured to securely retain a sensor therein, a plurality of crush ribs disposed on the inner surface and extending from an inner intermediate edge towards a top edge of the threaded body, the plurality of crush ribs configured to securely retain the sensor within the cavity defined by the inner surface;

an outer surface that is indexed to form an external screw thread, and a bottom flange that extends radially outward from a bottom edge of the threaded body; and a nut member that comprises a central cavity that extends therethrough and an internal screw thread that extends radially inward from an inner side wall of the nut member towards the central cavity, wherein the sensor mounting system is configured to be installed in a ceiling tile by removably coupling the nut member to the threaded body such that:

the threaded body is received through the central cavity of the nut member, the external screw thread of the threaded body engages the internal screw thread of the nut member, and the ceiling tile is clamped between the nut member and the bottom flange of the threaded body.

11. The sensor mounting system of claim 10, wherein the threaded body comprises a core that has a top portion that is substantially cylindrical shaped and a bottom portion that flares out from the top portion towards the bottom edge such that the bottom portion defines a shape of a frustum of a cone.

12. The sensor mounting system of claim 11, wherein the threaded body comprises an inner collar that extends radially inward from the inner intermediate edge of the core that is positioned between the top edge and the bottom edge of the threaded body towards the cavity, wherein the inner collar defines an intermediate aperture that is positioned between a top aperture of the threaded body defined by the top edge and a bottom aperture of the threaded body defined by the bottom edge.

13. The sensor mounting system of claim 12, wherein the sensor is disposed in the cavity at the top portion of the core such that the sensor rests on the inner collar and a portion of the sensor extends through the intermediate aperture towards the bottom aperture.

14. The sensor mounting system of claim 11, wherein the bottom portion of the core is configured to collect light and guide the light towards the top portion of the core where the sensor is disposed.

15. The sensor mounting system of claim 10, wherein a top surface of the bottom flange comprises one or more grip ribs.

16. The sensor mounting system of claim 11, wherein the outer surface of the threaded body comprises a plurality of fins that extend radially outward from the core, and wherein an outer edge of each fin is indexed to form a plurality of grooves such that the plurality of grooves of the plurality of fins collectively form a helical structure that defines the external screw thread.

17. The sensor mounting system of claim 16, wherein each fin is vertically oriented and extends from the bottom flange towards a top edge of the threaded body.

18. The sensor mounting system of claim 17, wherein a width of each fin measured from the core to the outer edge reduces from the top edge of the threaded body towards the bottom flange.

* * * * *